US007124963B2

(12) United States Patent
Goenka et al.

(10) Patent No.: US 7,124,963 B2
(45) Date of Patent: Oct. 24, 2006

(54) LOW PRESSURE FUEL INJECTOR NOZZLE

(75) Inventors: Lakhi N. Goenka, Ann Arbor, MI (US); Jeffrey Paul Mara, Livonia, MI (US); David Lee Porter, Westland, MI (US); David Ling-Shun Hung, Novi, MI (US); John Stefanski, Pinckney, MI (US)

(73) Assignee: Visteon Global Technologies, Inc., Van Buren Township, MI (US)

( * ) Notice: Subject to any disclaimer, the term of this patent is extended or adjusted under 35 U.S.C. 154(b) by 0 days.

(21) Appl. No.: 10/983,156

(22) Filed: Nov. 5, 2004

(65) Prior Publication Data

US 2006/0097075 A1 May 11, 2006

(51) Int. Cl.
*B05B 1/26* (2006.01)
*B05B 1/04* (2006.01)
*F02M 61/00* (2006.01)

(52) U.S. Cl. ..... 239/504; 239/88; 239/533.2; 239/533.12; 239/533.14; 239/593; 239/592; 239/596; 239/598

(58) Field of Classification Search ..... 239/88–94, 239/533.2, 533.11, 533.12, 533.14, 589, 593, 239/592, 596, 597, 598, 504
See application file for complete search history.

(56) References Cited

U.S. PATENT DOCUMENTS 3,326,191 A 6/1967 Berlyn
4,018,387 A 4/1977 Erb et al.
4,106,702 A 8/1978 Gardner et al.
4,139,158 A 2/1979 Uehido
4,254,915 A 3/1981 Muller
4,275,845 A 6/1981 Muller
4,346,848 A 8/1982 Malcolm
4,540,126 A 9/1985 Yoneda et al.
4,650,122 A 3/1987 Kienzle et al.
4,666,088 A 5/1987 Krauss et al.
4,801,095 A 1/1989 Banzhaf et al.
4,907,748 A 3/1990 Gardner et al.
5,163,621 A 11/1992 Kato et al.
5,201,806 A 4/1993 Wood
5,244,154 A 9/1993 Buchholz et al.
5,344,081 A 9/1994 Wakeman
5,383,597 A 1/1995 Sooriakumar et al.
5,402,943 A 4/1995 King et al.
5,449,114 A 9/1995 Wells et al.
5,497,947 A 3/1996 Potz et al.
5,533,482 A 7/1996 Naitoh
5,553,790 A * 9/1996 Findler et al. ..... 239/585.1
5,570,841 A 11/1996 Pace et al.
5,636,796 A * 6/1997 Oguma ..... 239/533.12
5,662,277 A 9/1997 Taubitz et al.
5,685,485 A 11/1997 Mock et al.
5,685,491 A 11/1997 Marks et al.

(Continued)

FOREIGN PATENT DOCUMENTS

EP 0 551 633 A1 7/1993

(Continued)

*Primary Examiner*—David A. Scherbel
*Assistant Examiner*—Seth Barney
(74) *Attorney, Agent, or Firm*—Brinks, Hofer Gilson & Lione

(57) ABSTRACT

A nozzle for a low pressure fuel injector that improves the control and size of the spray angle, as well as enhances the atomization of the fuel delivered to a cylinder of an engine.

19 Claims, 2 Drawing Sheets

U.S. PATENT DOCUMENTS 5,716,001 A 2/1998 Wakeman et al.
5,716,009 A 2/1998 Ogihara et al.
5,762,272 A 6/1998 Tani et al.
5,911,366 A 6/1999 Maier et al.
5,915,352 A 6/1999 Okamoto et al.
5,924,634 A 7/1999 Arndt et al.
5,934,571 A 8/1999 Schmidt et al.
6,029,913 A 2/2000 Stroia et al.
6,045,063 A 4/2000 Koike et al.
6,050,507 A 4/2000 Holzgrefe et al.
6,092,743 A 7/2000 Shibata et al.
6,102,299 A 8/2000 Pace et al.
6,168,094 B1 1/2001 Schatz et al.
6,168,095 B1 1/2001 Seitter et al.
6,176,441 B1 1/2001 Munezane et al.
6,257,496 B1 7/2001 Wyant
6,273,349 B1 8/2001 Fischbach et al.
6,296,199 B1 10/2001 Noller et al.
6,308,901 B1 10/2001 Nitkiewicz et al.
6,330,981 B1 12/2001 Nally, Jr. et al.
6,394,367 B1 5/2002 Munezane et al.
6,405,945 B1 6/2002 Dobrin
6,439,482 B1 8/2002 Hosoyama et al.
6,439,484 B1 8/2002 Harata et al.
6,494,388 B1 12/2002 Mueller et al.
6,499,674 B1 12/2002 Ren et al.
6,502,769 B1 1/2003 Imoehl
6,513,724 B1 2/2003 Joseph et al.
6,520,145 B1 2/2003 Hunkert
6,533,197 B1 3/2003 Takeuchi et al.
6,547,163 B1 * 4/2003 Mansour et al. ..... 239/404
6,578,778 B1 6/2003 Koizumi et al.
6,581,574 B1 6/2003 Moran et al.
6,616,072 B1 9/2003 Harata et al.
6,626,381 B1 9/2003 Parrish
6,644,565 B1 11/2003 Hockenberger
6,666,388 B1 12/2003 Ricco
6,669,103 B1 12/2003 Tsai
6,669,116 B1 12/2003 Iwase
6,685,112 B1 2/2004 Hornby et al.
6,695,229 B1 2/2004 Heinbuch et al.
6,705,274 B1 3/2004 Kubo
6,708,904 B1 3/2004 Itatsu
6,708,905 B1 3/2004 Borissov et al.
6,708,907 B1 3/2004 Fochtman et al.
6,712,037 B1 3/2004 Xu
6,719,223 B1 4/2004 Yukinawa et al.
6,722,340 B1 4/2004 Sukegawa et al.
6,739,525 B1 5/2004 Dantes et al.
6,742,727 B1 6/2004 Peterson, Jr.
6,758,420 B1 7/2004 Arioka et al.
6,764,033 B1 7/2004 Dantes et al.
6,766,969 B1 7/2004 Haltiner, Jr. et al.
6,783,085 B1 8/2004 Xu
6,817,545 B1 11/2004 Xu
6,848,636 B1 2/2005 Munezane et al.
6,921,022 B1 7/2005 Nally et al.
6,929,196 B1 8/2005 Togashi et al.
6,966,499 B1 11/2005 Nally et al.
7,011,257 B1 * 3/2006 Heyse ..... 239/533.2
7,014,129 B1 * 3/2006 Dantes et al. ..... 239/533.2
7,017,839 B1 * 3/2006 Heyse ..... 239/533.12
2001/0017325 A1 8/2001 Harata et al.
2002/0008166 A1 1/2002 Fukaya et al.
2002/0092929 A1 7/2002 Arimoto
2002/0144671 A1 10/2002 Shiraishi et al.
2002/0170987 A1 11/2002 Aoki et al.
2003/0052201 A1 * 3/2003 Maier et al. ..... 239/585.1
2003/0127540 A1 7/2003 Xu
2003/0127547 A1 7/2003 Nowak
2003/0141385 A1 7/2003 Xu
2003/0141387 A1 7/2003 Xu
2003/0173430 A1 9/2003 Spencer
2003/0234005 A1 12/2003 Sumisha et al.
2004/0026538 A1 * 2/2004 Heyse ..... 239/533.12
2004/0046063 A1 * 3/2004 Heyse ..... 239/533.12
2004/0050976 A1 3/2004 Kitamura
2004/0060538 A1 4/2004 Togashi et al.
2004/0099243 A1 * 5/2004 Dantes et al. ..... 123/294
2004/0104285 A1 6/2004 Okamoto et al.
2004/0129806 A1 7/2004 Dantes et al.

FOREIGN PATENT DOCUMENTS

EP 0 611 886 B1 12/1998
GB 2 232 203 A 12/1990
JP 2-19654 1/1990
JP 5-280442 1/1993
JP 6-221163 8/1994
JP 2001-046919 2/2001
WO WO 93/04277 3/1993
WO WO 93/20349 10/1993
WO WO 95/04881 2/1995

* cited by examiner

LOW PRESSURE FUEL INJECTOR NOZZLE

FIELD OF THE INVENTION

The present invention relates generally to fuel injectors for automotive engines, and more particularly relates to fuel injector nozzles capable of atomizing fuel at relatively low pressures.

BACKGROUND OF THE INVENTION

Stringent emission standards for internal combustion engines suggest the use of advanced fuel metering techniques that provide extremely small fuel droplets. The fine atomization of the fuel not only improves emission quality of the exhaust, but also improves the cold weather start capabilities, fuel consumption and performance. Typically, optimization of the droplet sizes dependent upon the pressure of the fuel, and requires high pressure delivery at roughly 7 to 10 MPa. However, a higher fuel delivery pressure causes greater dissipation of the fuel within the cylinder, and propagates the fuel further outward away from the injector nozzle. This propagation makes it more likely that the fuel spray will condense on the walls of the cylinder and the top surface of the piston, which decreases the efficiency of the combustion and increases emissions.

To address these problems, a fuel injection system has been proposed which utilizes low pressure fuel, define herein as generally less than 4 MPa, while at the same time providing sufficient atomization of the fuel. One exemplary system is found in U.S. Pat. No. 6,712,037, commonly owned by the Assignee of the present invention, the disclosure of which is hereby incorporated by reference in its entirety. Generally, such low pressure fuel injectors employ sharp edges at the nozzle orifice for atomization and acceleration of the fuel. However, the relatively low pressure of the fuel and the sharp edges result in the spray being difficult to direct and reduces the range of the spray. More particularly, the spray angle or cone angle produced by the nozzle is somewhat more narrow. At the same time, additional improvement to the atomization of the low pressure fuel would only serve to increase the efficiency and operation of the engine and fuel injector.

Accordingly, there exists a need to provide a fuel injector having a nozzle design capable of sufficiently injecting low pressure fuel while increasing the control and size of the spray angle, as well as enhancing the atomization of the fuel.

BRIEF SUMMARY OF THE INVENTION

One embodiment of the present invention provides a nozzle for a low pressure fuel injector which increases the spray angle and gives better control over the direction of the spray of fuel delivery to a cylinder of an engine. The nozzle generally comprises a nozzle body and a metering plate. The nozzle body defines a valve outlet and a longitudinal axis. The metering plate is connected to the nozzle body and is in fluid communication with the valve outlet. The metering plate has a bottom wall and a side wall, the bottom and side walls defining a nozzle cavity receiving fuel from the valve outlet. The metering plate defines a plurality of exit cavities receiving fuel from the nozzle cavity. Each exit cavity is radially spaced from the longitudinal axis and meets the nozzle cavity at an exit orifice. The side wall is sloping relative to the bottom wall. In particular, the slope between the side wall and the bottom wall varies circumferentially around the nozzle cavity.

According to more detailed aspects, the exit orifices and exit cavities are formed in the side wall. The bottom wall preferably includes a planar portion generally perpendicular to the longitudinal axis. Each exit cavity defines an exit axis oriented relative to the longitudinal axis and thus the orientation of the exit axes varies circumferentially around the nozzle. Stated another way, the exit axes are angled relative to the longitudinal axis, and the exit angles very circumferentially around the nozzle. Preferably, the side wall is angled relative to the bottom wall and the angle varies linearly, although it may vary non-linearly. The sloping of the side wall results in the nozzle cavity narrowing in the area proximate the exit cavities. The resulting fuel spray produced by the plurality of exit cavities is directed along an offset axis that is angled relative to the longitudinal axis.

BRIEF DESCRIPTION OF THE DRAWINGS

The accompanying drawings incorporated in and forming a part of the specification illustrate several aspects of the present invention, and together with the description serve to explain the principles of the invention. In the drawings.

DETAILED DESCRIPTION OF THE INVENTION

Figure 1:
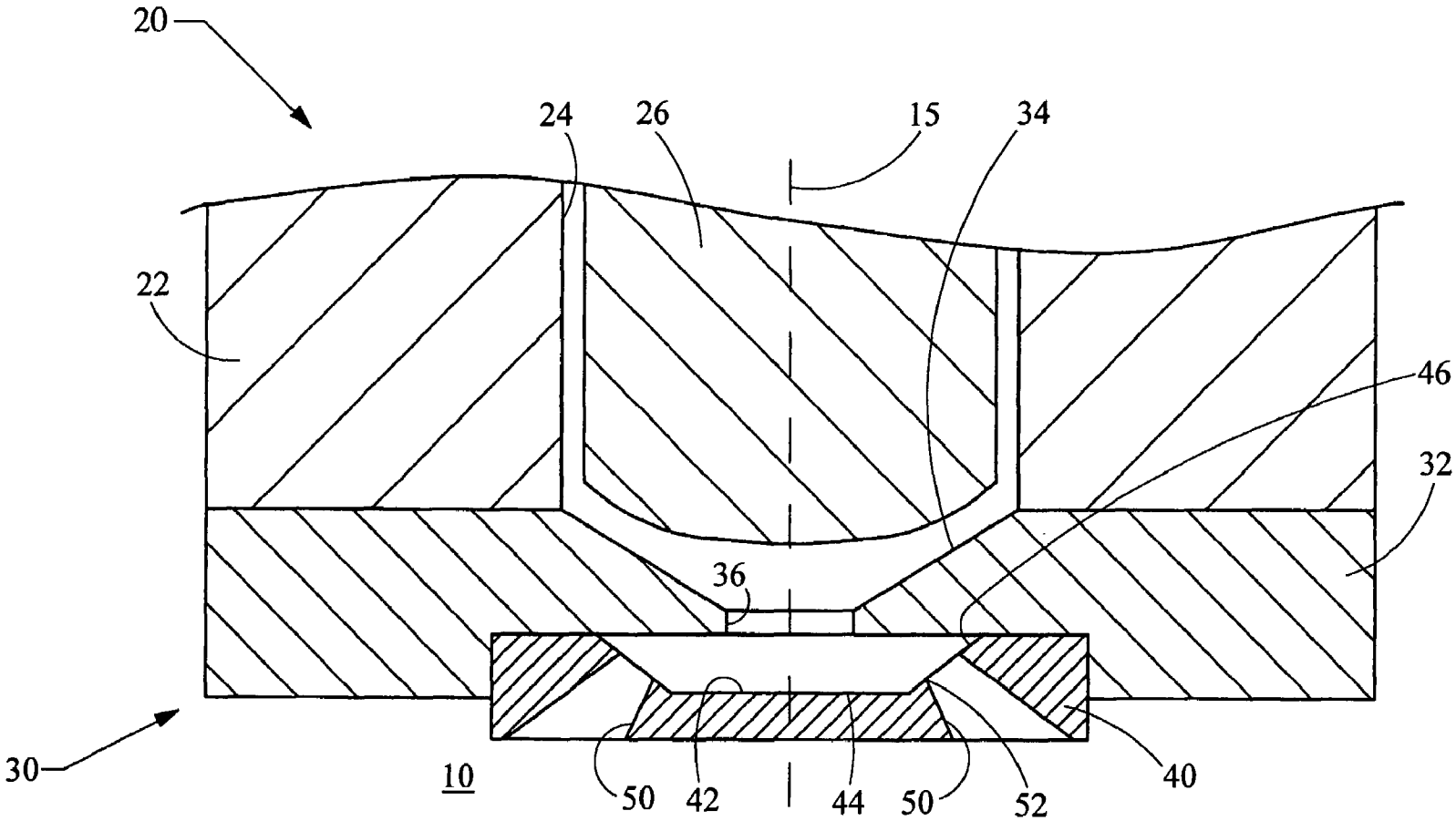
FIG. 1 depicts a cross-sectional view, partially cut-away, of a nozzle for a low pressure fuel injector constructed in accordance with the teachings of the present invention.

Turning now to the figures, FIG. 1 depicts a cross-sectional of a nozzle 20 constructed in accordance with the teachings of the present invention. The nozzle 30 is formed at a lower end of a low pressure fuel injector 20 which is used to deliver fuel to a cylinder 10 of an engine, such as an internal combustion engine of an automobile. An injector body 22 defines an internal passageway 24 having a needle 26 positioned therein. The injector body 22 defines a longitudinal axis 15, and the internal passageway 24 extends generally parallel to the longitudinal axis 15. A lower end of the injector body 22 defines a nozzle body 32. It will be recognized by those skilled in the art that the injector body 22 and nozzle body 32 may be integrally formed, or alternatively the nozzle body 32 may be separately formed and attached to the distal end of the injector body 22 by welding or other well known techniques.

In either case, the nozzle body 32 defines a valve seat 34 leading to a valve outlet 36. The needle 26 is translated longitudinally in and out of engagement with the valve seat 34 preferably by an electromagnetic actuator or the like. In this manner, fuel flowing through the internal passageway 24 and around the needle 26 is either permitted or prevented from flowing to the valve outlet 36 by the engagement or disengagement of the needle 26 and valve seat 34.

The nozzle 30 further includes a metering plate 40 which is attached to the nozzle body 32. It will be recognized by those skilled in the art that the metering plate 40 may be integrally formed with the nozzle body 32, or alternatively may be separately formed and attached to the nozzle body 32 by welding or other well known techniques. In either case, the metering plate 40 defines a nozzle cavity 42 receiving fuel from the valve outlet 36. The nozzle cavity 42 is generally defined by a bottom wall 44 and a side wall 46 which are formed into the metering plate 40. The bottom wall 44 has a planar portion spaced radially inwardly from the side wall 46. The metering plate 40 further defines a plurality of exit cavities 50 receiving fuel from the nozzle cavity 42. Each exit cavity 50 is radially spaced from the longitudinal axis 15 and meets the nozzle cavity 42 at an exit orifice 52.

Figure 2:
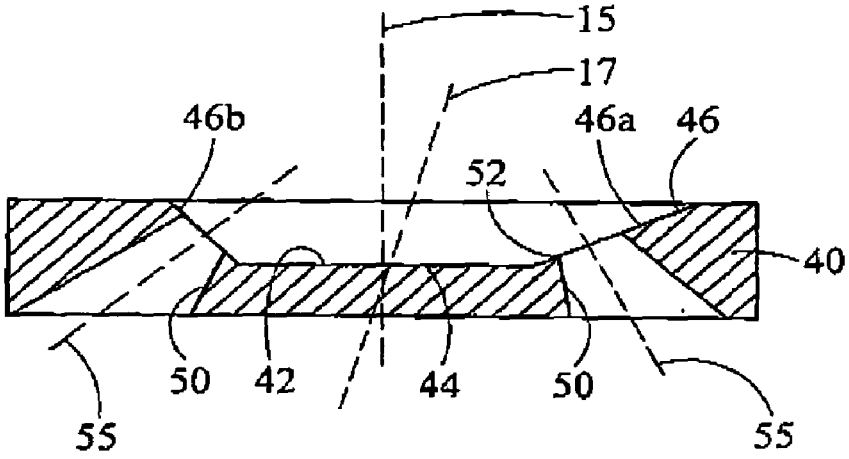
FIG. 2 depicts an enlarged cross-sectional view of the metering plate forming a portion of the nozzle depicted in FIG. 1.
Figure 3:
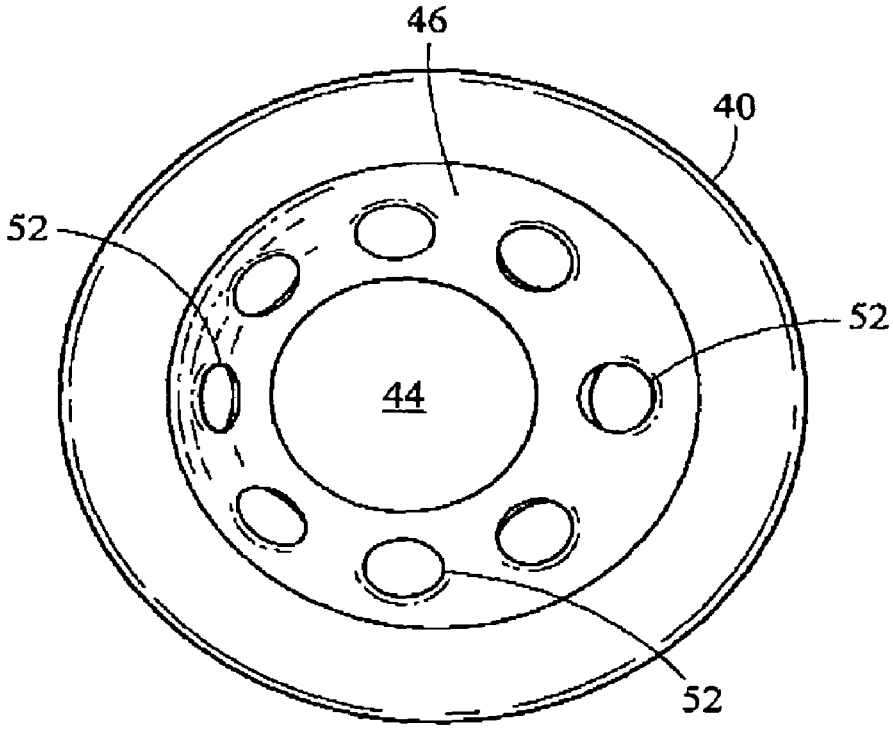
FIG. 3 is a plan view of the metering plate depicted in FIG. 2.

The metering plate 40 has been uniquely designed to improve the control over the direction of the fuel spray, as well as increase the angle of the fuel spray delivered to a cylinder of an engine. With reference to FIGS. 2 and 3, the metering plate 40 includes a side wall 46 which is sloped relative to the bottom wall 44. As a result of the sloping side wall 46, the nozzle cavity 42 narrows in the area proximate the exit cavities. As shown in FIG. 2, the sidewall 46 may be angled relative to the bottom wall 44, although it will be recognized by those skilled in the art that the side wall 46 can be arcuate in shape.

The slope between the side wall 46 and the bottom wall 44 varies circumferentially around the nozzle cavity. This is best seen by viewing FIGS. 2 and 3 in conjunction. For example, the side wall 46*a* on the right side of the page in FIG. 2 is sloped to a lesser extent than the side wall 46*b* on the left side of the page in FIG. 2. Looking at FIG. 3, which is a plan view of the metering plate 40, the side wall 46 has a thickness which varies circumferentially around the plate 40. In FIG. 3, the thickness in the planar view of the side wall 46 is smallest at the top of the page, while the planar view thickness of the side wall 46 is largest at the bottom of the page in FIG. 3. Likewise, it can be seen that the top surface 60 of the metering plate 40 varies in its radial thickness depending upon the slope of the side wall 46.

It will also be recognized that the exit cavities 50 are located in the side wall 46, and more particularly the exit orifices 52 are formed in the side wall 46. Accordingly, the exit cavities 50 are each oriented along an exit axis 55, the plurality of exit axes varying circumferentially around the metering plate 40. That is, each exit cavity 50 is aligned along an exit axis 55 which is angled relative to the longitudinal axis 15. It will be recognized by those skilled in the art that the varying orientation of the exit axes 55 results in the total fuel spray produced by the plurality of exit cavities 50 to be directed along an offset axis 17 which is angled relative to the longitudinal axis 15.

The angle between the side wall 46 and bottom wall 44 preferably varies linearly, although it may vary non-linearly. Likewise, the angles of the plurality of exit axes 55 relative to the longitudinal axis varies linearly as one moves from orifice to orifice, although the variation may be non-linear. The angle of the side wall 46 and/or exit axes 55 may vary in stages, i.e. sections, or may constantly vary circumferentially around the metering plate 40.

Accordingly, it will be recognized by those skilled in art that the varying slope of the side wall 46, and the varying orientation of the exit axes 55 of the exit cavities 50, result in an offset fuel axis 17 which provides greater control and range to the resultant fuel spray delivered to the cylinder 10 of an engine. Further, the structure and orientation of each exit cavity, in concert with the plurality of exit cavities, enhances the spray angle and control over the direction of the spray.

The foregoing description of various embodiments of the invention has been presented for purposes of illustration and description. It is not intended to be exhaustive or to limit the invention to the precise embodiments disclosed. Numerous modifications or variations are possible in light of the above teachings. The embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

The invention claimed is:

1. A nozzle for a low pressure fuel injector, the fuel injector delivering fuel to a cylinder of an engine, the nozzle comprising:

a nozzle body defining a valve outlet and a longitudinal axis;

a metering plate connected to the nozzle body and in fluid communication with the valve outlet;

the metering plate having a bottom wall and a side wall, the bottom and side walls defining a nozzle cavity receiving fuel from the valve outlet;

the metering plate defining a plurality of exit cavities receiving fuel from the nozzle cavity, each exit cavity being radially spaced from the longitudinal axis, each exit cavity meeting the nozzle cavity at an exit orifice; and the side wall sloping at an angle relative to the bottom wall, the angle between the side wall and bottom wall varying circumferentially around the nozzle cavity.

2. The nozzle of claim 1, wherein the exit orifices are formed in the side wall.

3. The nozzle of claim 1, wherein the fuel spray produced by the plurality of exit cavities is directed along an offset axis that is angled relative to the longitudinal axis.

4. The nozzle of claim 1, wherein the bottom wall includes a planar portion generally perpendicular to the longitudinal axis.

5. The nozzle of claim 1, wherein each exit cavity defines an exit axis oriented relative to the longitudinal axis, and wherein the orientation of the exit axes vary circumferentially around the nozzle.

6. The nozzle of claim 5, wherein the exit axes are angled relative to the longitudinal axis, and wherein the exit angles vary circumferentially around the nozzle.

7. The nozzle of claim 1, wherein side wall is angled relative to the bottom wall, and wherein the angle between the side wall and bottom wall varies linearly.

8. The nozzle of claim 7, wherein the angle between the side wall and bottom wall varies non-linearly.

9. The nozzle of claim 1, wherein the side wall is arcuate.

10. The nozzle of claim 1, wherein the side wall is planar.

11. The nozzle of claim 1, wherein the nozzle cavity narrows in the area proximate the exit cavities.

12. A nozzle for a low pressure fuel injector, the fuel injector delivering fuel to a cylinder of an engine, the nozzle comprising:

an injector body defining a valve outlet and a longitudinal axis;

a metering plate connected to the injector body and in fluid communication with the valve outlet;

the metering plate having a bottom wall and a side wall, the bottom and side walls defining a nozzle cavity receiving fuel from the valve outlet, the angle of the side wall relative to the bottom wall varying circumferentially around the nozzle;

the metering plate defining a plurality of exit cavities receiving fuel from the nozzle cavity, each exit cavity radially spaced from the longitudinal axis and defining an exit axis oriented relative to the longitudinal axis, each exit cavity meeting the nozzle cavity at an exit orifice; and the angle of the exit axes of adjacent exit cavities relative to the longitudinal axis being different.

13. The nozzle of claim 12, wherein the fuel spray produced by the combination of the plurality of exit cavities is directed along an offset axis that is angled relative to the longitudinal axis.

14. The nozzle of claim 12, wherein the exit cavities are formed in the side wall.

15. The nozzle of claim 12, wherein the side wall is angled relative to the bottom wall.

16. The nozzle of claim 12, wherein the exit angles of the plurality of exit cavities vary circumferentially around the nozzle.

17. The nozzle of claim 16, wherein the angle between the exit axes and the longitudinal axis varies linearly.

18. The nozzle of claim 16, wherein the angle between the exit axes and the longitudinal axis varies non-linearly.

19. A nozzle for a low pressure fuel injector, the fuel injector delivering fuel to a cylinder of an engine, the nozzle comprising:

an injector body defining a valve outlet and a longitudinal axis;

a metering plate connected to the injector body and in fluid communication with the valve outlet;

the metering plate having a bottom wall and a side wall, the side wall sloping relative to the bottom wall, the bottom and side walls defining a nozzle cavity receiving fuel from the valve outlet;

the metering plate defining a plurality of exit cavities receiving fuel from the nozzle cavity, each exit cavity radially spaced from the longitudinal axis and defining a exit axis oriented relative to the longitudinal axis; and the exit cavities being formed in the side wall, the angle between the side wall and bottom wall varying circumferentially around the nozzle cavity, the angle of the exit axes relative to the longitudinal axis varying circumferentially around the nozzle.

* * * * *